US005885021A

United States Patent [19]

Chang

[11] Patent Number: 5,885,021

[45] Date of Patent: Mar. 23, 1999

[54] DOCUMENT BOARD FOR PUNCHING CORRECT HOLES

[76] Inventor: Tsai-Yuan Chang, P.O. Box 90, Tainan City, Taiwan

[21] Appl. No.: 938,952

[22] Filed: Jun. 28, 1997

[51] Int. Cl.[6] ..... B42F 3/00

[52] U.S. Cl. ..... 402/1; 402/4

[58] Field of Search ..... 402/1, 4, 80 R; 281/28, 29; 83/582, 167

[56] References Cited

U.S. PATENT DOCUMENTS 5,209,592 5/1993 Bedol ..... 402/4 X
5,340,229 8/1994 Schwartzman ..... 402/1 X
5,403,108 4/1995 Karlis ..... 402/1
5,638,730 6/1997 Karlis ..... 402/1 X

*Primary Examiner*—Willmon Fridie, Jr.

[57] ABSTRACT

A document board for punching correct holes includes a base board, a movable device disposed in a first recess in the base board, an upper cap disposed in the first recess on the movable device, two adjusting plates disposed on the upper cap, and a puncher fitted in a second recess of the base board and secured by a position unit. The adjustable plates either can be moved by corresponding action of the movable device to opposite direction to move papers to be punched and placed on the upper cap to a correct position for punching by the puncher to get correct holes for filing, without inconvenience of position papers to be punched by a puncher.

4 Claims, 3 Drawing Sheets

DOCUMENT BOARD FOR PUNCHING CORRECT HOLES

BACKGROUND OF THE INVENTION

This invention concerns a document board for punching correct holes, particularly, having two adjusting plates for moving papers to be punched to a correct position for punching swiftly.

Generally, documents are filed after punched holes for subsequent checking in an effective way. However, a conventional way of punching holes for file includes steps of overlapping papers correctly and then folded into half for making a center line and then pushed in a gap of puncher, aligning the folded line with a center line of the puncher, and finally punched by compressing a punch grip of the puncher. However, in folding operation, some sheets of papers overlapped may have the folded lines biasing owing to thickness. Then punches holes may be not all correct, resulting in not neat filing.

SUMMARY OF THE INVENTION

The purpose of the invention is to offer a document board for punching correct holes.

One feature of the invention is a base board having a first recess for disposing a movable device and an upper cap therein and a second recess for placing a puncher therein.

Another feature of the invention is two adjusting plates disposed on the upper cap for moving two movable plates for moving papers to be punched and placed on the upper cap to a correct position for punching.

Another feature of the invention is the movable device consisting of a gear and two movable plates respectively having a rack to engage with the gear to be moved in opposite direction when either of the two adjusting plates is moved to hold papers to be punched in a correct position.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
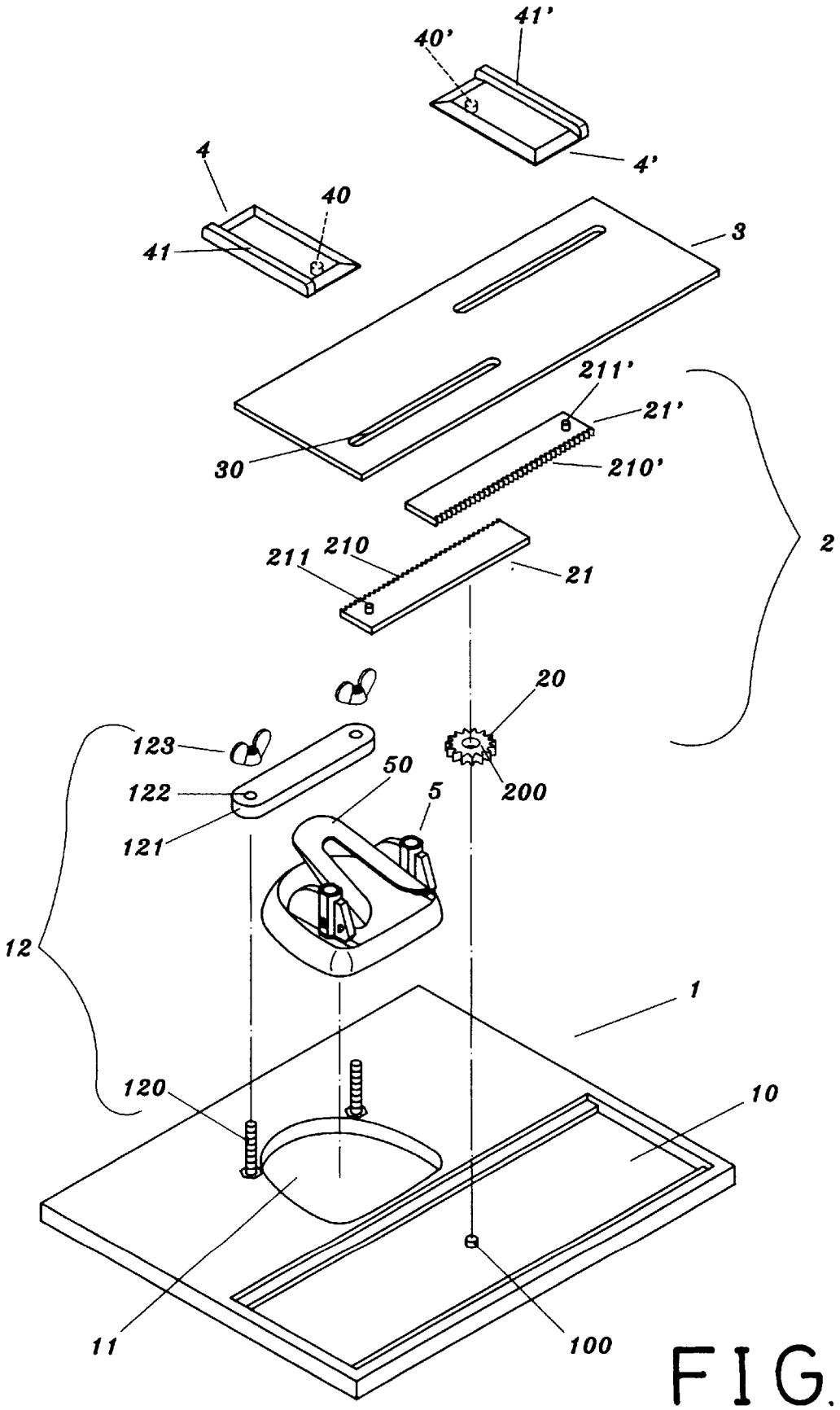
FIG. 1 is an exploded perspective view of a document board being capable of having papers to be punched correctly in the present invention.

A preferred embodiment of a document board for punching correct holes in the present invention, as shown in FIG. 1, includes a flat base board 1, which has a first rectangular recess 10 formed in a front portion, a projection 100 standing upright on a surface in a center section of the first recess 10, a second oval-shaped recess 11 formed in a center section of a rear portion, a position unit 12 disposed at a rear side of the first recess 11. The position unit 12 has two threaded rods 120, 120, an elongate position plate 121 provided with two holes 122, 122 respectively near two sides, and two butterfly nuts 123, 123 screwing with the threaded rods 120, 120 on the position plate 121 for tighten the plate 121 on a puncher 5.

The document board further includes a moving device 2, which is disposed in the recess 10 of the base board 1, having a gear 20 provided with a center hole 200 for the projection 100 to fit therein to support the gear 20 to rotate, two movable plates 21, 21' respectively provided with a rack side 210, 210' to engage with the gear 20 and a projection 211, 211' on a side of an upper surface.

Further, the document board further includes an upper cap 3, which has a rectangular flat shape and two long slots 30 for the two projections 211, 211' of the movable plates 21, 21' to fit and move therein, fitting in the first recess 10 of the base board 1 and covering on the moving device 2.

Further, two adjusting plates 4, 4 are provided in the document board, respectively having a hole 40 for the projections 21, 21' to fit therein, and an outer rest side 41 formed with a little high wall respectively.

Further, a common puncher 5 is placed in the second recess 11 of the base board 1, having a compress grip 50 for punching holes, and secured by means of the position unit 12.

Figure 2:
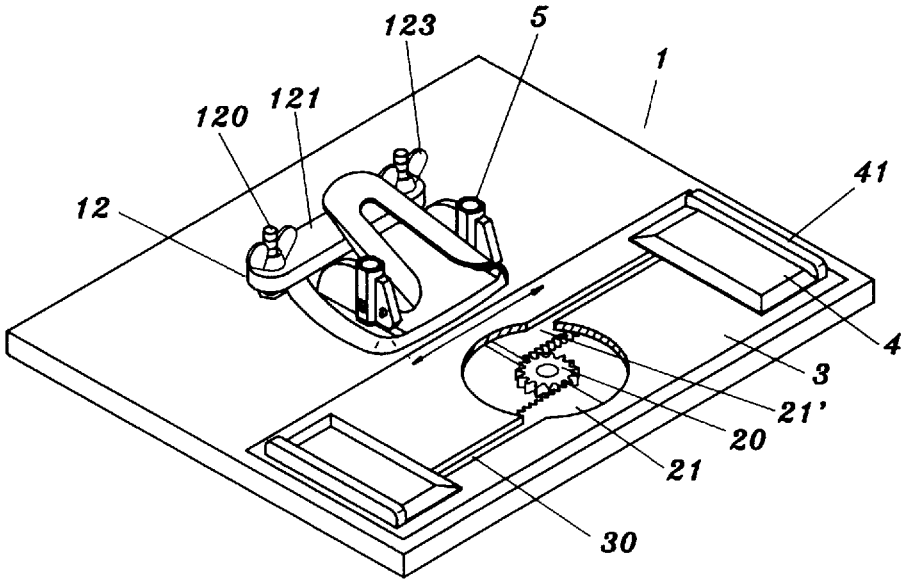
FIG. 2 is a perspective view of the document document board being capable of having papers to be punched correctly in the present invention; and, FIG. 3 is a perspective view of the document board used for punching papers in the present invention.

In assembling, referring to FIG. 2, firstly, the moving unit 2 is assembled together, with the projections 211, 211' of the moving plates 21, 21 fitted respectively in the long slots 30, 30 of the cap 3, with the two holes 40, 40 of the adjusting plates 4, 4 temporarily fitted with the projections 211, 211' of the movable plates 21, 21', with the center hole 200 of the gear 20 fitted with projection 100 of the moving unit 2. Then the two adjusting plates 4, 4 and the movable plates 21, 21' and the cap 3 are temporarily combined with the base board 1 on the first recess 10, with the rack sides 210, 210' of the movable plates 21, 21' engaging respectively with two sides of the gear 20 in the first recess 10. Then the gear 20 and the two movable plates 21, 21' engage and move with one another, and if one of the two movable plates 21, 21' is pulled to the right or the left, the movable plates 21, 21' also move to the right or the left, and the gear also rotates at the same time. The two adjusting plates 4, 4 are also moved together with the two movable plates 21, 21' in the same distance. In addition, the cap 3 has its upper surface in the same level with the surface of the base board 1. Then the puncher 5 is deposited in the second recess 11 of the base board, with the punch grip 50 facing rearward. Lastly, the fix plate 121 is combined on the puncher 5, with the two holes 122, 122 passed through by the two threaded rods 120, 120, with the butterfly nuts 123, 123 screwing with the rods 120, 120, thus securing the puncher 5 on the base board 1.

Figure 3:
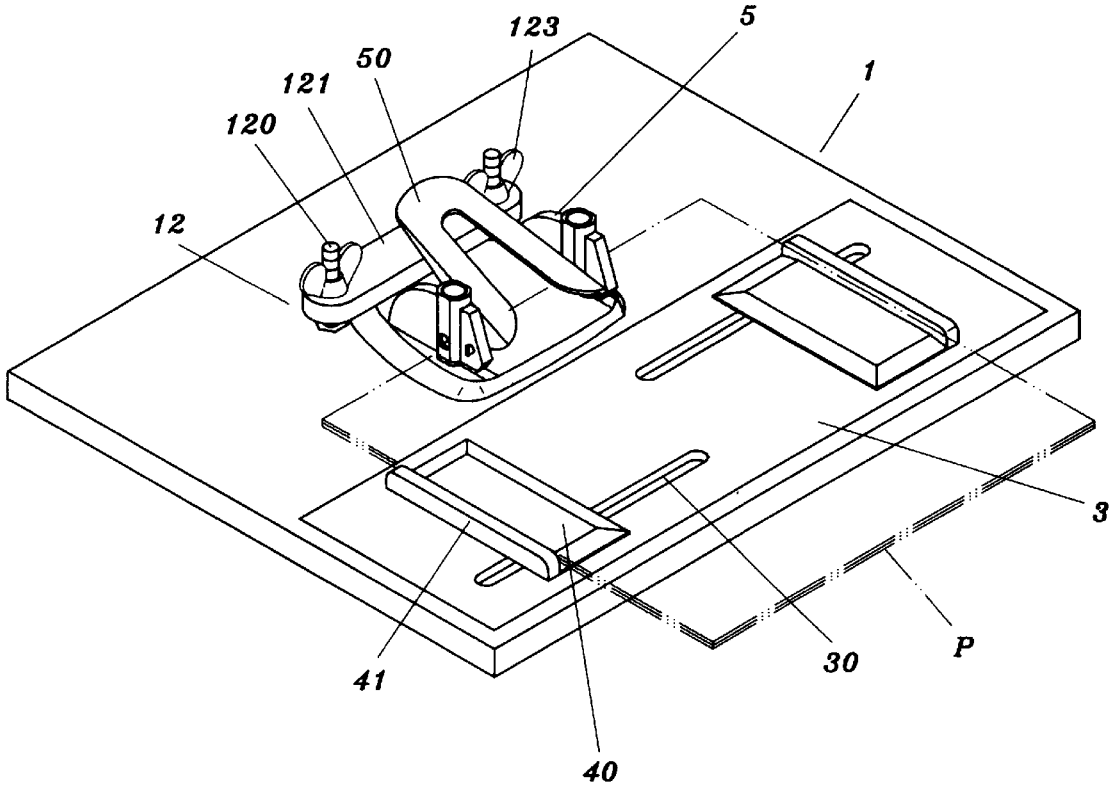

In using the document board for punching papers, as shown in FIG. 3, papers P to be punched are placed on the cap 3, and either of the adjusting plates 4 is adjusted, moved inward to permit the rest sides 41, 41 of the two adjusting plates 4, 4 contact and move two opposite sides of the papers P, which are then automatically moved to a correct position for punching, whether the size of the papers P is large or small. After that, the papers are pushed forward into a gap of the puncher 5 always fitted unmovable in the second recess 11, and punch grip 50 is compressed down for punching. As the center line of the puncher 5 and the papers P aer always aligned, so punched holes are always kept correct, without inconvenience of position papers to be punched in a gap of a puncher 5 in a symmetrical way.

While the preferred embodiment of the invention has been described above, it will be recognized and understood that various modifications may be made therein and the appended claims are intended to cover all such modifications which may fall within the spirit and scope of the invention.

What is claimed is:

1. A document board for punching correct holes comprising:

a base board having a first recess formed in a front portion, a projection standing up in the center of said first recess, a second recess behind said first recess and in a center section of a rear portion, and a position unit provided near a rear side of said second recess;

a movable device disposed in said first recess of said base board, having a gear provided with a center hole fitting with said projection in said first recess of said base board, two elongate movable plates positioned respectively in front of and behind of said gear and respectively having a rack in a contact side with said gear to engage with said gear so as to be moved in opposite directions by said gear;

an upper cap fitted in said first recess of said base board, having two long slots respectively in a corresponding locations with said movable plates of said movable device;

two adjusting plates, movably positioned on said upper cap, either of said two adjusting plates able to be moved to move said movable plates of said movable device synchronously;

a puncher fitted in said second recess of said base board and secured by said position unit of said base board; and, either of said two adjusting plates being moved to move papers of any size placed on said upper cap to a correct position with a center line of said papers being in line with a center line of said puncher, said papers then being pushed into a gap of said puncher for said punch grip to punch holes for filing, removing inconvenience of placing papers to be punched in a symmetrical correct position for punched by a puncher, and speeding filing work in a neat mode.

2. The document board for punching correct holes as claimed in claim 1, wherein said position unit of said base board comprises two threaded rods, a fix plate provided with two holes respectively in two sides for said threaded rods to fit through, and two butterfly nuts screwing with said two threaded rods tight to secure said puncher in said second recess of said base board.

3. The document board for punching correct holes as claimed in claim 1, wherein said movable plates of said movable device respectively have a projection in a side far from each other, and said adjustable plates respectively have a hole in a back surface to fit with said projection of each said movable plate, with either of said adjustable plates being moved outward or inward to move said two movable plates of said movable device in opposite direction and in the same distance.

4. The document board for punching correct holes as claimed in claim 1, wherein said two adjusting plates respectively have an outer rest side provided with a little high wall for two opposite sides of papers to be punched to rest against so as to be positioned correctly for punching.

* * * * *